US006776130B2

(12) United States Patent
Miyakoshi et al.

(10) Patent No.: US 6,776,130 B2
(45) Date of Patent: Aug. 17, 2004

(54) CONTROL APPARATUS OF VARIABLE VALVE TIMING MECHANISM AND METHOD THEREOF

(75) Inventors: Ryo Miyakoshi, Atsugi (JP); Kenichi Machida, Atsugi (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/695,002

(22) Filed: Oct. 29, 2003

(65) Prior Publication Data

US 2004/0083999 A1 May 6, 2004

(30) Foreign Application Priority Data

Oct. 31, 2002 (JP) ..... 2002-318371

(51) Int. Cl.[7] ..... F01L 1/34

(52) U.S. Cl. ..... 123/90.15; 123/90.17; 123/90.16; 123/90.31

(58) Field of Search ..... 123/90.15, 90.16, 123/90.17, 90.18, 90.27, 90.31, 347, 348, 349, 350; 701/114, 115

(56) References Cited

U.S. PATENT DOCUMENTS 4,282,573 A * 8/1981 Imai et al. ..... 701/114
5,363,817 A * 11/1994 Ikeda et al. ..... 123/90.15
6,502,543 B1 * 1/2003 Arai et al. ..... 123/348
6,684,837 B2 * 2/2004 Miyakoshi ..... 123/90.17
6,691,024 B2 * 2/2004 Kunz ..... 701/114

FOREIGN PATENT DOCUMENTS

JP 2000-297686 A 10/2000

* cited by examiner

*Primary Examiner*—Thomas Denion
*Assistant Examiner*—Ching Chang
(74) *Attorney, Agent, or Firm*—Foley & Lardner LLP

(57) ABSTRACT

A rotation phase of a camshaft relative to a crankshaft is detected based on a crank angle signal and a cam angle signal, and also the currents or voltages of electromagnetic brakes constituting a variable valve timing mechanism are converted into the rotation phase, to estimate a change in the rotation phase during the rotation phase is detected, based on the rotation phase obtained by converting the currents or voltages.

17 Claims, 10 Drawing Sheets

CONTROL APPARATUS OF VARIABLE VALVE TIMING MECHANISM AND METHOD THEREOF

FIELD OF THE INVENTION

The present invention relates to a control apparatus and a control method of a variable valve timing mechanism that varies valve timing of engine valves by changing a rotation phase of a camshaft relative to a crankshaft.

RELATED ART OF THE INVENTION

Heretofore, there has been known a control apparatus of a variable valve timing mechanism as disclosed in Japanese Unexamined Patent Publication No. 2000-297686.

Such a conventional control apparatus comprises a cam sensor outputting a signal at a reference rotation position of a camshaft, and a crank angle sensor outputting a signal at a reference rotation position of a crankshaft.

In such a control apparatus, an angle of from the reference rotation position of the crankshaft to the reference rotation position of the camshaft is detected based on signals from the cam sensor and the crank angle sensor.

Then, an actuator of the variable valve timing mechanism is feedback controlled so that the above angle (rotation phase) reaches a desired value.

According to the above constitution, the rotation phase is detected at each fixed crank angle.

However, a feedback control of actuator is typically executed at each fixed period of time (for example, 10 ms).

Therefore, at a low rotation time of engine, a detection period of rotation phase becomes longer than a period of feedback control.

At this time, the feedback control is executed based on the rotation phase which differs from an actual rotation phase, during a detection value of the rotation phase is updated. As a result, there occurs the overshooting of rotation phase.

SUMMARY OF THE INVENTION

It is therefore an object of the present invention to enable to prevent the overshooting of rotation phase when a detection period of rotation phase becomes longer than a period of feedback control.

In order to accomplish the above-mentioned object, the present invention is constituted so that a rotation phase is detected based on a signal synchronized with the rotation of a crankshaft and a signal synchronized with the rotation of a camshaft, and also controlled variable of an actuator of a variable valve timing mechanism is detected, to convert the controlled variable into the rotation phase with a transfer function representing the variable valve timing mechanism.

Then, an estimation value of the rotation phase is calculated based on the rotation phase detected based on the rotation synchronized signals and the rotation phase obtained by converting the controlled variable, and an operation signal is output to the actuator based on the estimation value and a desired value.

The other objects and features of the invention will become understood from the following description with reference to the accompanying drawings.

DESCRIPTION OF THE PREFERRED EMBODIMENT

Figure 1:
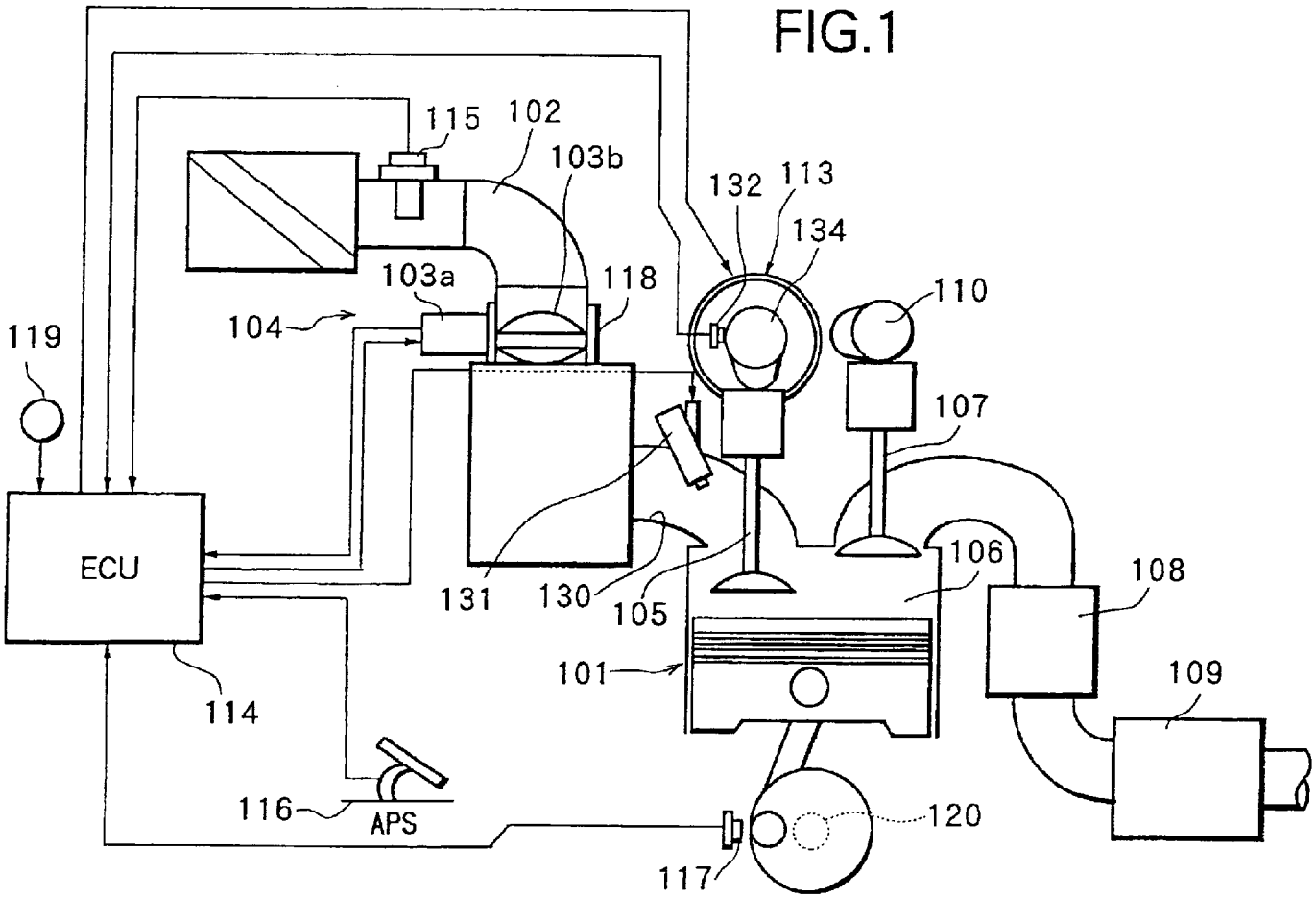
FIG. 1 is a diagram of a system structure of an internal combustion engine in an embodiment.

FIG. 1 is a structural diagram of an internal combustion engine for vehicle in an embodiment.

In FIG. 1, in an intake pipe 102 of an engine 101, an electronically controlled throttle 104 is disposed, and air is sucked into a combustion chamber 106 via electronically controlled throttle 104 and an intake valve 105.

In electronically controlled throttle valve 104, a throttle valve 103*b* is driven to open/close by a throttle motor 103*a*.

A combusted exhaust gas is discharged from combustion chamber 106 via an exhaust valve 107, and is purified by a front catalyst 108 and a rear catalyst 109, and then emitted into the atmosphere.

Intake valve 105 and exhaust valve 107 are driven to open/close by cams disposed to an intake side camshaft 134 and to an exhaust side camshaft 111, respectively.

Intake side camshaft 134 is disposed with a variable valve timing mechanism 113.

Variable valve timing mechanism 113 changes a rotation phase of intake side camshaft 134 relative to a crankshaft 120, to vary valve timing of intake valve 105.

Further, an electromagnetic type fuel injection valve 131 is disposed on an intake port 130 for each cylinder.

Fuel injection valve 131 injects fuel adjusted at a predetermined pressure toward intake valve 105, when driven to open by an injection pulse signal from an engine control unit (ECU) 114.

ECU 114 incorporating therein a microcomputer receives detection signals from various sensors.

Engine control unit 114 controls electronically controlled throttle 104, variable valve timing mechanism 113 and fuel injection valve 131 by calculation process based on the detection signals.

There are provided, as the various sensors, an accelerator opening sensor APS 116 detecting an accelerator opening, an air flow meter 115 detecting an intake air amount Q of engine 101, a throttle sensor 118 detecting an opening TVO of throttle valve 103*b*, and a water temperature sensor 119 detecting a cooling water temperature of engine 101.

Further, there is provided a crank angle sensor 117 outputting a reference crank angle signal REF at each 180° rotation of crankshaft 120 and also outputting a position signal POS at each unit angle (1° to 10°) rotation of crankshaft.

Furthermore, there is provided a cam sensor 132 outputting a cam angle signal CAM at each 90° rotation of intake side camshaft 134.

Note, since intake side camshaft 134 is rotated twice during crankshaft 120 is rotated once, 90° of intake side camshaft 134 corresponds to 180° of crankshaft 120.

ECU 114 calculates an engine rotation speed Ne based on a period of reference crank angle signal REF or the number of position signals POS generated per predetermined time of period.

Next, a constitution of variable valve timing mechanism 113 will be described based on FIGS. 2 to 5.

Variable valve timing mechanism 113 comprises camshaft 134, a drive plate 2, an assembling angle adjusting mechanism 4, an operating apparatus 15 and a cover 6.

Drive plate 2 is transmitted with the rotation of engine 101 (crankshaft 120) to be rotated.

Assembling angle adjusting mechanism 4 is the one that changes an assembling angle between camshaft 134 and drive plate 2, and is operated by operating apparatus 15.

Cover 6 is mounted across a cylinder head (not shown in the figures) and a front end of a rocker cover, to cover front surfaces of drive plate 2 and assembling angle adjusting mechanism 4.

A spacer 8 is fitted with a front end (left side in FIG. 2) of camshaft 134.

The rotation of spacer 8 is restricted with a pin 80 that is inserted through a flange portion 134*f* of camshaft 134.

Camshaft 134 is formed with a plurality of oil galleries in radial.

Spacer 8 is formed with a flange 8*a*, a cylinder portion 8*b* extending axially from a front end surface of flange 8*a*, and a shaft supporting portion 8*d* formed on an outside of cylinder portion 8*b*, that is, the front end surface of flange 8*a*.

Shaft supporting portion 8*d* is disposed at three locations at even intervals on the outside of cylinder portion 8*b*, and is formed with a hole 8*c* parallel with an axial direction.

Further, spacer 8 is formed with a plurality of oil galleries 8*r* for supplying oil, in a radial direction.

Drive plate 2 is mounted to spacer 8 so as to be relatively rotated in a state where the axial displacement thereof is restricted by flange 8*a*.

Figure 3:
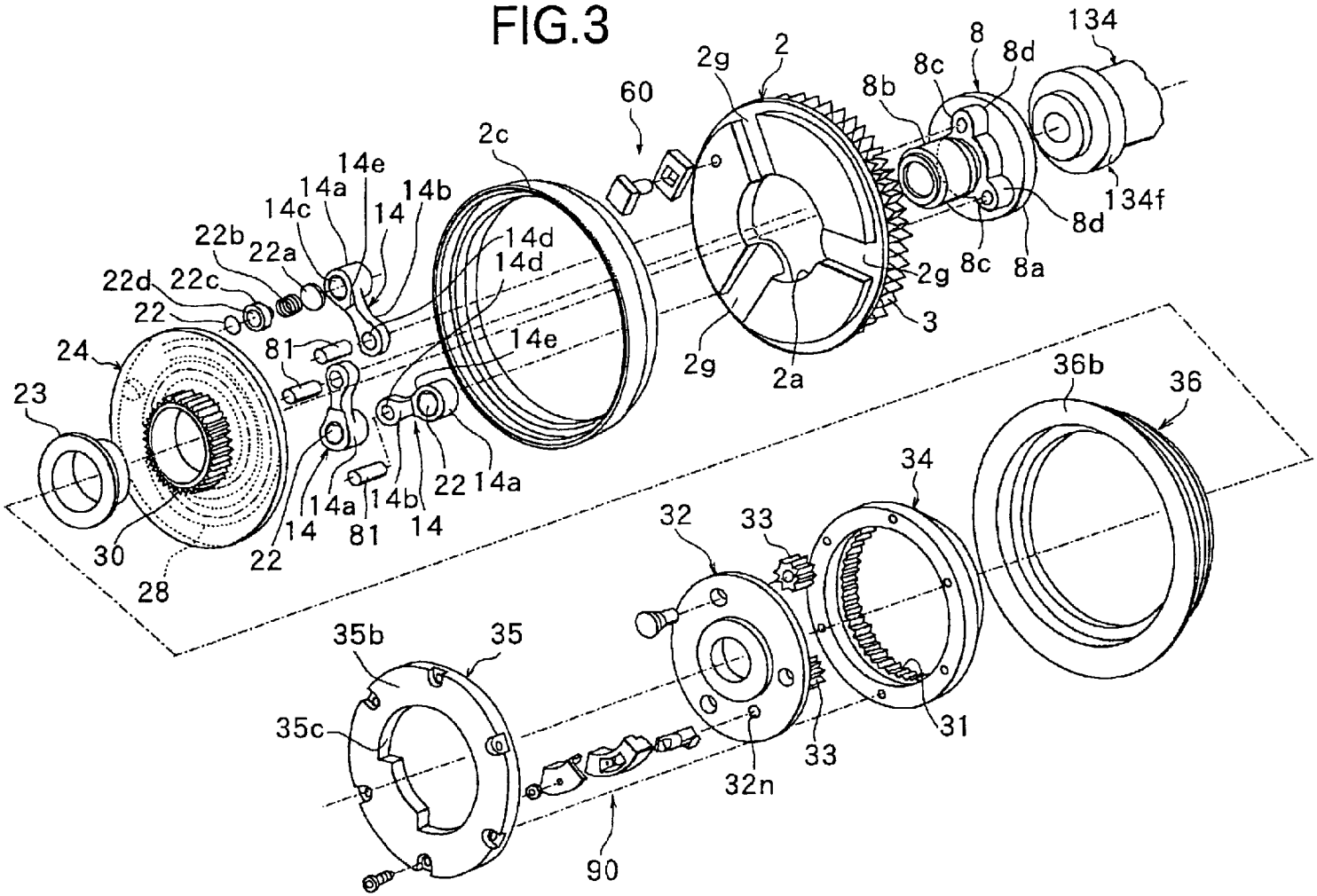
FIG. 3 is an exploded perspective view of the variable valve timing mechanism.

A timing sprocket that is transmitted with the rotation of crankshaft 120 is formed on a rear outer periphery of drive plate 2, as shown in FIG. 3.

Further, on a front end surface of drive plate 2, three guide grooves 2*g* extending in radial are formed at each 120°.

Moreover, to an outer periphery portion of the front end surface of drive plate 2, a cover member 2*c* of annular shaped is fixed by welding or press fitting.

Above described assembling angle adjusting mechanism 4 is arranged on the front end portion side of camshaft 134 and drive plate 2, to change a relative assembling angle between camshaft 134 and drive plate 2.

Assembling angle adjusting mechanism 4 includes three link arms 14, as shown in FIG. 3.

Each link arm 14 is provided with, at a tip portion thereof, a cylinder portion 14*a* as a sliding portion, and is provided with an arm portion 14*b* extending from cylinder portion 14*a* in an outer diameter direction.

A hole 14*c* is formed on cylinder portion 14*a*, while a hole 14*d* is formed on a base end portion of arm portion 14*b*.

Link arm 14 is mounted so as to be rotatable around a rotation pin 81, by inserting rotation pin 81 fitted into a hole 8*c* of spacer 8 through hole 14*d*.

On the other hand, cylinder portion 14*a* of link arm 14 is inserted into guide groove 2*g* of drive plate 2, to be mounted so as to be movable along guide groove 2*g*.

In the above constitution, when cylinder portion 14*a* receives an outer force to displace along guide groove 2*g*, rotation pin 81 transfers circumferentially by an angle according to a radial displacement amount of cylinder portion 14*a*.

Then, camshaft 134 is relatively rotated with respect to drive plate 2 due to the displacement of rotation pin 81.

Figure 4:
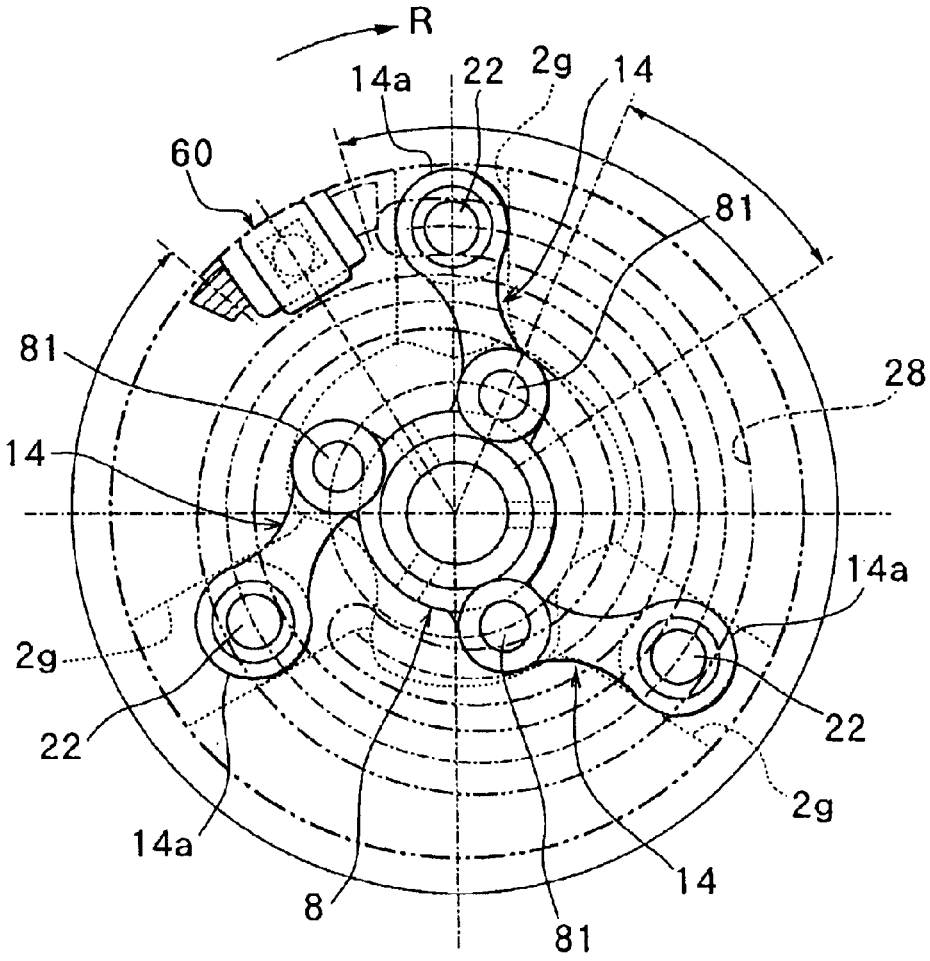
FIG. 4 is a cross section view along A—A in FIG. 2.
Figure 5:
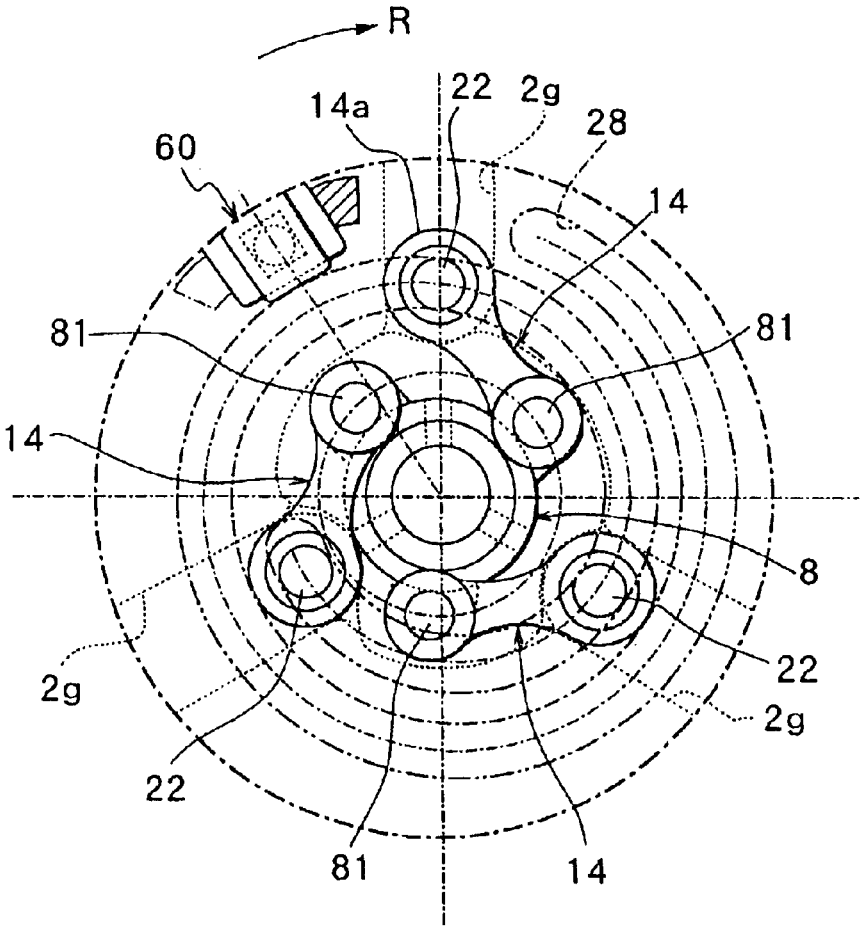
FIG. 5 is a cross section view along A—A in FIG. 2.

FIGS. 4 and 5 show an operation of assembling angle adjusting mechanism 4.

As shown in FIG. 4, when cylinder portion 14*a* is arranged on an outer periphery side of drive plate 2, rotation pin 81 on the base end portion is close to guide groove 2*g*, and this position is a most retarded position of valve timing.

On the other hand, as shown in FIG. 5, when cylinder portion 14*a* is arranged on an inner periphery side of drive plate 2, rotation pin 81 is pressed circumferentially to depart from guide groove 2*g*, and this position is a most advance position of valve timing.

The radial transfer of cylinder portion 14*a* in assembling angle adjusting mechanism 4 is performed by operating apparatus 15.

Operating apparatus 15 is provided with an operation conversion mechanism 40 and a speed increasing/reducing mechanism 41.

Operation conversion mechanism 40 is provided with a sphere 22 held in cylinder portion 14*a* of link arm 14, and a guide plate 24 coaxially formed so as to face the front face of drive plate 2.

Operation conversion mechanism 40 converts the rotation of guide plate 24 into the radial displacement of cylinder portion 14*a* of link arm 14.

Guide plate 24 is supported so as to be relatively rotatable with respect to an outer periphery of cylinder portion 8*b* of spacer 8 via a metal bush 23.

On a rear face of guide plate 24, a spiral guide groove 28 is formed, and on guide plate 24, an oil gallery 24*r* for supplying oil is formed.

Sphere 22 is fitted with spiral guide groove 28.

Figure 2:
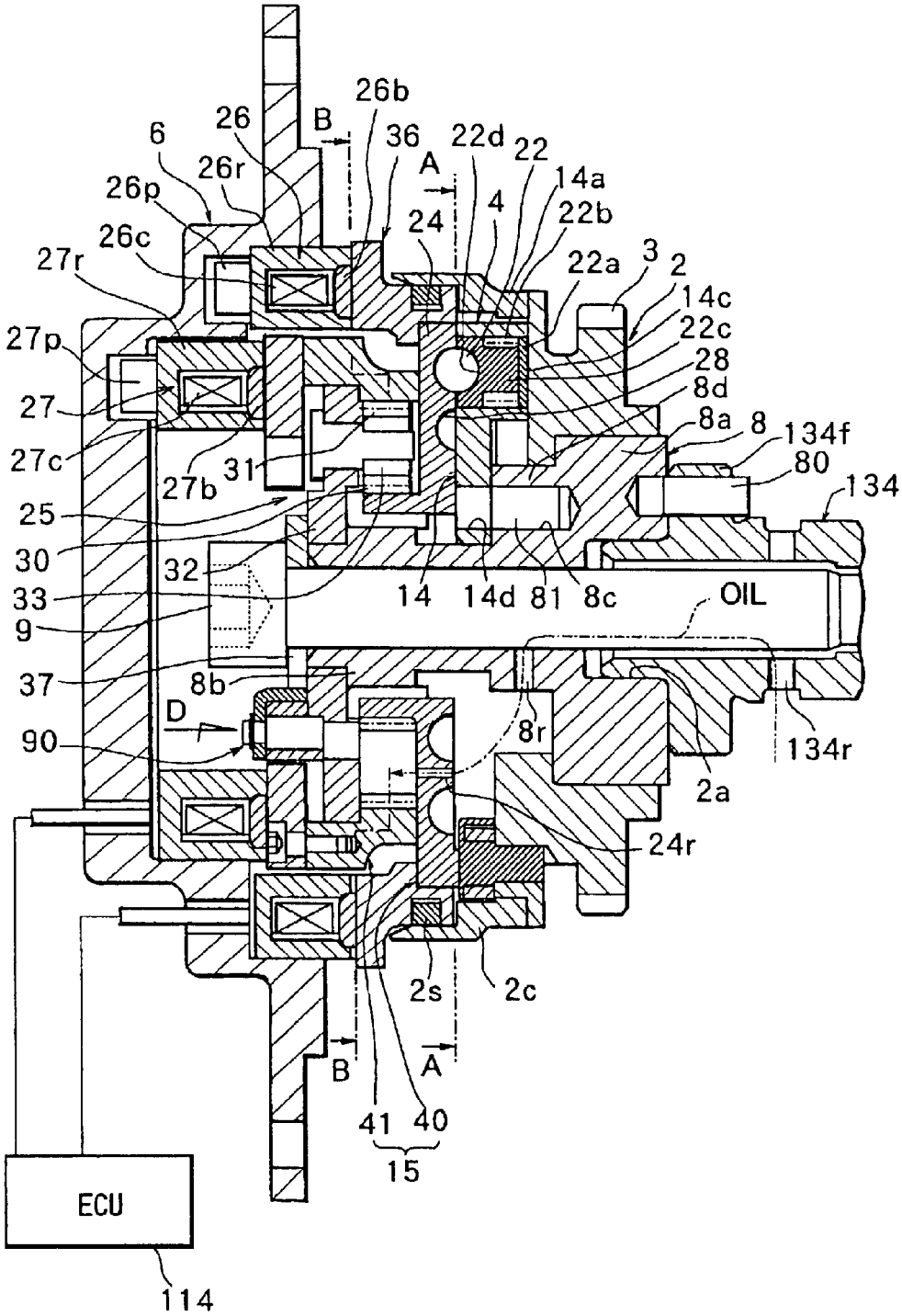
FIG. 2 is a cross section view showing a variable valve timing mechanism in the embodiment.

As shown in FIGS. 2 and 3, a supporting panel 22*a*, a coil spring 22*b*, a retainer 22*c* and sphere 22 are inserted in this sequence into hole 14*c* disposed to cylinder portion 14*a* of link arm 14.

Retainer 22*c* is formed with a supporting portion 22*d* for supporting sphere 22 in a state where sphere 22 protrudes, and also formed, on an outer periphery thereof, with a flange 22*f* on which coil spring 22*b* is seated.

In an assembling condition as shown in FIG. 2, coil spring 22*b* is compressed, supporting panel 22*a* is pressed to the front face of drive plate 2, and sphere 22 is fitted with spiral guide groove 28.

Further, as shown in FIGS. 4 and 5, spiral guide groove 28 is formed so as to gradually reduce a diameter thereof along a rotation direction R of drive plate 2.

Accordingly, if guide plate 24 is relatively rotated with respect to drive plate 2 in the rotation direction R, sphere 22 transfers to outside along spiral guide groove 28. Thus, cylinder portion 14*a* moves to outside as shown in FIG. 4, and rotation pin 81 connected with link arm 14 is dragged so as to become closer to guide groove 2*g*, so that camshaft 134 is relatively rotated in a retarded direction.

On the contrary, if guide plate 24 is relatively rotated with respect to drive plate 2 in an opposite direction to the rotation direction R from the above condition, sphere 22 transfers to inside along spiral guide groove 28. Thus, cylinder portion 14*a* transfers to inside as shown in FIG. 5, and rotation pin 81 connected with link arm 14 is pressed so as to depart from guide 2*g*, so that camshaft 134 is relatively rotated in an advance direction.

Speed increasing/reducing mechanism 41 will be described in detail.

Speed increasing/reducing mechanism 41 is for transferring (speed increasing) guide plate 24 with respect to drive plate 2 in the rotation direction R or for transferring (speed reducing) guide plate 24 with respect to drive plate 2 in the opposite direction to the rotation direction R.

Speed increasing/reducing mechanism 41 is provided with a planetary gear mechanism 25, a first electromagnetic brake 26 and a second electromagnetic brake 27.

Planetary gear mechanism 25 is provided with a sun gear 30, a ring gear 31, and a planetary gear 33 engaged with the both gears 30 and 31.

As shown in FIGS. 2 and 3, sun gear 30 is formed integrally with an inner periphery on a front face side of guide plate 24.

Planetary gear 33 is rotatably supported by a carrier plate 32 fixed to the front end portion of spacer 8.

Ring gear 31 is formed on an inner periphery of an annular rotor 34 that is rotatably supported by an outer side of carrier plate 32.

Carrier plate 32 is fitted with the front end portion of spacer 8 and is fixed to camshaft 134 by a bolt 9 via a washer 37.

A braking plate 35 having a braking face 35*b* is fixed to a front end surface of rotor 34.

Further, a braking plate 36 having a braking face 36*b* is fixed to an outer periphery of guide plate 24 integrally formed with sun gear 30.

Accordingly, in planetary gear mechanism 25, if planetary gear 33 is not rotated but is revolved together with carrier plate 32, in a condition where first and second electromagnetic brakes 26 and 27 are not operated, sun gear 30 and ring gear 31 are rotated at the same speed.

If only first electromagnetic brake 26 is operated from the above condition, guide plate 24 is relatively rotated in a direction to be retarded with respect to carrier plate 32 (direction opposite to the R direction in FIGS. 4 and 5).

On the other hand, if only second electromagnetic brake 27 is operated from the above condition, a braking force is given to link gear 31 only, so that ring gear 31 is relatively rotated in a direction to be retarded with respect to carrier plate 32. Thus, planetary gear 33 is rotated, and the rotation of planetary gear 33 increases a speed of sun gear 30, so that guide plate 24 is relatively rotated to the rotation direction R side with respect to drive plate 2.

First and second electromagnetic brakes 26 and 27 are arranged so as to face braking faces 36*b* and 35*b* of braking plates 36 and 35, respectively.

Further, first and second electromagnetic brakes 26 and 27 include cylinder members 26*r* and 27*r* that are supported by pins 26*p* and 27*p* on a rear surface of cover 6, in floating states where only the rotation thereof are restricted by pins 26*p* and 27*p*.

These cylinder members 26*r* and 27*r* house therein coils 26*c* and 27*c*, respectively, and are also respectively mounted with friction members 26*b* and 27*b* that are pressed to braking faces 35*b* and 36*b* when power is supplied to each of coils 26*c* and 27*c*.

Cylinder members 26*r* and 27*r*, and braking plates 35 and 36 are formed of magnetic substance, such as iron, for generating a magnetic field when the power is supplied to each of coils 26*c* and 27*c*.

On the contrary, cover 6 is formed of non-magnetic substance, such as aluminum, for preventing leakage of magnetic flux at the time of power supply, and friction members 26*b* and 27*b* are formed of non-magnetic substance, such as aluminum, for preventing from being made to be permanent magnet, to be attached to braking plates 35 and 36 at the time of non-power supply.

The relative rotation of drive plate 2 and guide plate 24 is restricted by an assembling angle stopper 60 at the most retarded position and the most advance position.

Further, in planetary gear mechanism 25, a planetary gear stopper 90 is disposed between braking plate 35 formed integrally with ring gear 31, and carrier plate 32.

Operation conversion mechanism 40 described above is constituted such that a position of cylinder portion 14*a* of link arm 14 is maintained so that a relative assembling position between drive plate 2 and camshaft 134 does not fluctuate, in the non-operating conditions of first and second electromagnetic brakes 26 and 27. Such a constitution will be described.

A driving torque is transmitted via link arm 14 and spacer 8 to camshaft 134 from drive plate 2. While, a fluctuating torque of camshaft 134 due to a reaction force from the engine valve is input from camshaft 134 to link arm 14, as a force F of a direction to connect pivoting points on both ends of link arm 14 from rotation pin 81.

Since cylinder portion 14*a* of link arm 14 is guided in radial along guide groove 2*g*, and also sphere 22 protruding forwards from cylinder portion 14*a* is fitted with spiral guide groove 28, the force F input via each link arm 14 is supported by the left and right walls of guide groove 2*g* and spiral guide groove 28 of guide plate 24.

Accordingly, the force F input to link arm 14 is divided into two components FA and FB orthogonal to each other, and these components FA and FB are received in directions orthogonal to a wall on the outer periphery of spiral guide groove 28 and orthogonal to one wall of guide groove 2*g*, respectively.

Therefore, cylinder portion 14*a* of link arm 14 is prevented from transferring along guide groove 2*g*. Thus, link arm 14 is prevented from being rotated.

Therefore, after guide plate 24 is rotated by the braking forces of respective electromagnetic brakes 26 and 27, and link arm 14 is rotated to a predetermined position, the position of link arm 14 is maintained and a rotation phase between drive plate 2 and camshaft 134 is held as it is, without the necessity of continuously providing braking force.

An operation of variable valve timing mechanism 113 will be described hereafter.

In the case where a rotation phase of camshaft 134 with respect to crankshaft is controlled to a retarded side, the power is supplied to second electromagnetic brake 27.

If the power is supplied to second electromagnetic brake 27, friction member 27*b* of second electromagnetic brake 27 contacts with brake plate 35, and a braking force is acted on ring gear 31 of planetary gear mechanism 25, so that sun gear 30 is increasingly rotated with the rotation of timing sprocket 3.

Guide plate 24 is rotated in the rotation direction R side with respect to drive plate 2 by the increase rotation of sun gear 30, and as a result, camshaft 134 is displaced to the retarded side.

This displacement to the retarded side is restricted at the most retarded position shown in FIG. 4 by assembling angle stopper 60.

On the other hand, in the case where the assembling angle of camshaft 134 is displaced to the advance direction, the power is supplied to first electromagnetic brake 26.

Thereby, the braking force of first brake 26 acts on guide plate 24, and guide plate 24 is rotated in the direction opposite to the rotation direction R with respect to drive plate 2, so that camshaft 134 is displaced to the advance side.

This displacement to the advance side is restricted at the most advance position shown in FIG. 5 by assembling angle stopper 60.

ECU 114 sets a target advance value (target rotation phase) of camshaft 134 relative to crankshaft 120 based on engine operating conditions (load, rotation).

Further, ECU 114 measures a phase difference between the reference crank angle signal REF of crank angle sensor 117 and the cam angle signal CAM of cam sensor 132, to detect an advance value (rotation phase).

Then, ECU 114 feedback controls the power supply to first and second electromagnetic brakes 26 and 27, so that an actual advance value coincides with the target advance value.

Figure 6:
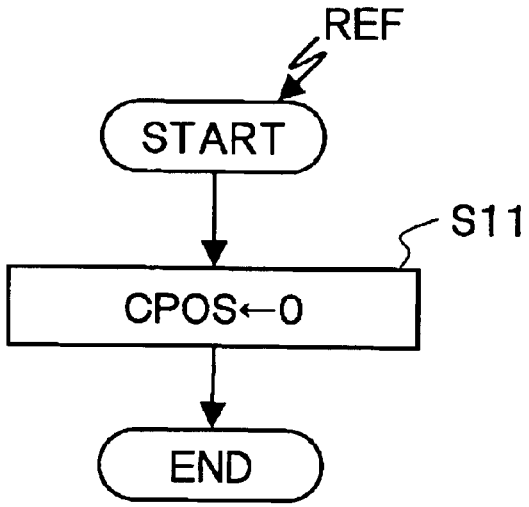
FIG. 6 is a flowchart showing a resetting process of a counter CPOS in the embodiment.
Figure 7:
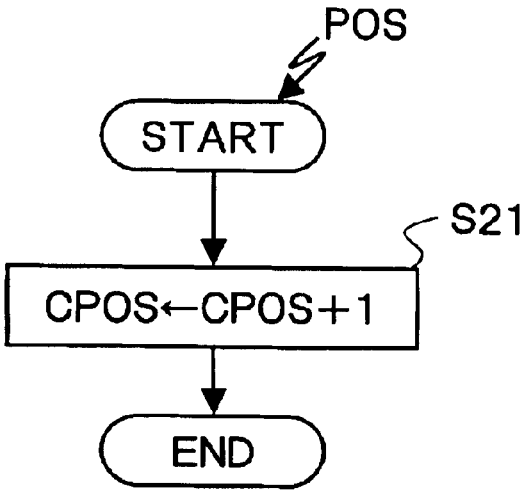
FIG. 7 is a flowchart showing a counting up process of the counter CPOS in the embodiment.
Figure 8:
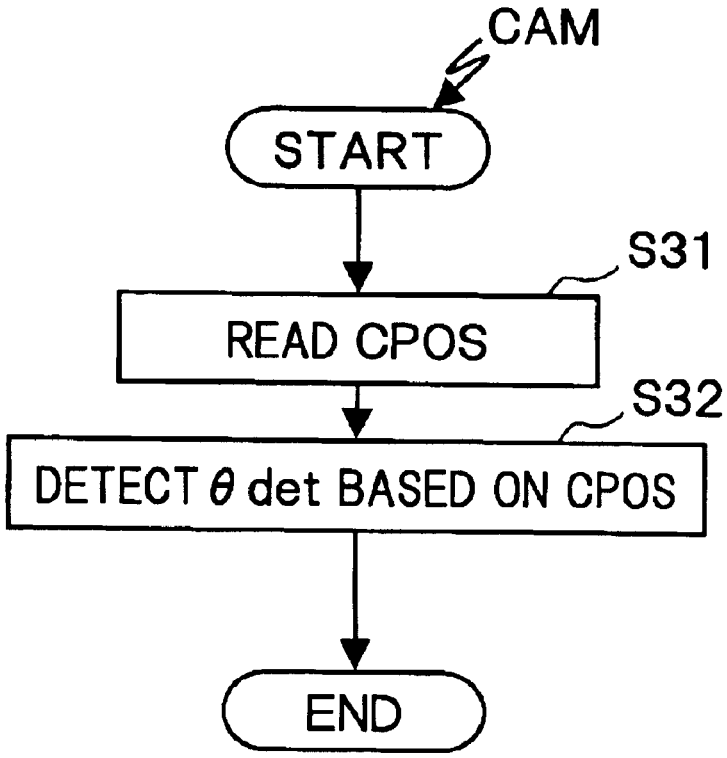
FIG. 8 is a flowchart showing a calculation process of a detection value θdet for each cam signal CAM in the embodiment.

Flowcharts in FIG. 6 to FIG. 8 show the process of detecting the advance value.

The routine shown in the flowchart of FIG. 6 is interruptedly executed at each time when the reference crank angle signal REF is output from crank angle sensor 117. In step S11, a counter CPOS counting up the number of generated position signals POS is reset to zero.

Further, the routine shown in the flowchart of FIG. 7 is interruptedly executed at each time when the position signal POS is output from crank angle sensor 117. In step S21, counter CPOS is counted up to 1.

Accordingly, counter CPOS is reset to zero when the reference crank angle signal REF is generated, and thereafter, is counted up to a value obtained by counting up the number of generated position signals POS.

The routine shown in the flowchart of FIG. 8 is interruptedly executed at each time when the cam angle signal CAM is output from cam sensor 132.

In step S31, a value of counter CPOS at the time is read.

The value of counter CPOS indicates a rotation angle of from the time when the reference crank angle signal REF is generated to the time when the cam angle signal CAM is generated.

In step S32, a detection value θdet of the angle value (rotation phase) of camshaft 134 relative to crankshaft 120 is calculated based on the value of counter CPOS.

Accordingly, the detection value θdet is updated at each time when the cam angle signal CAM is generated.

Figure 9:
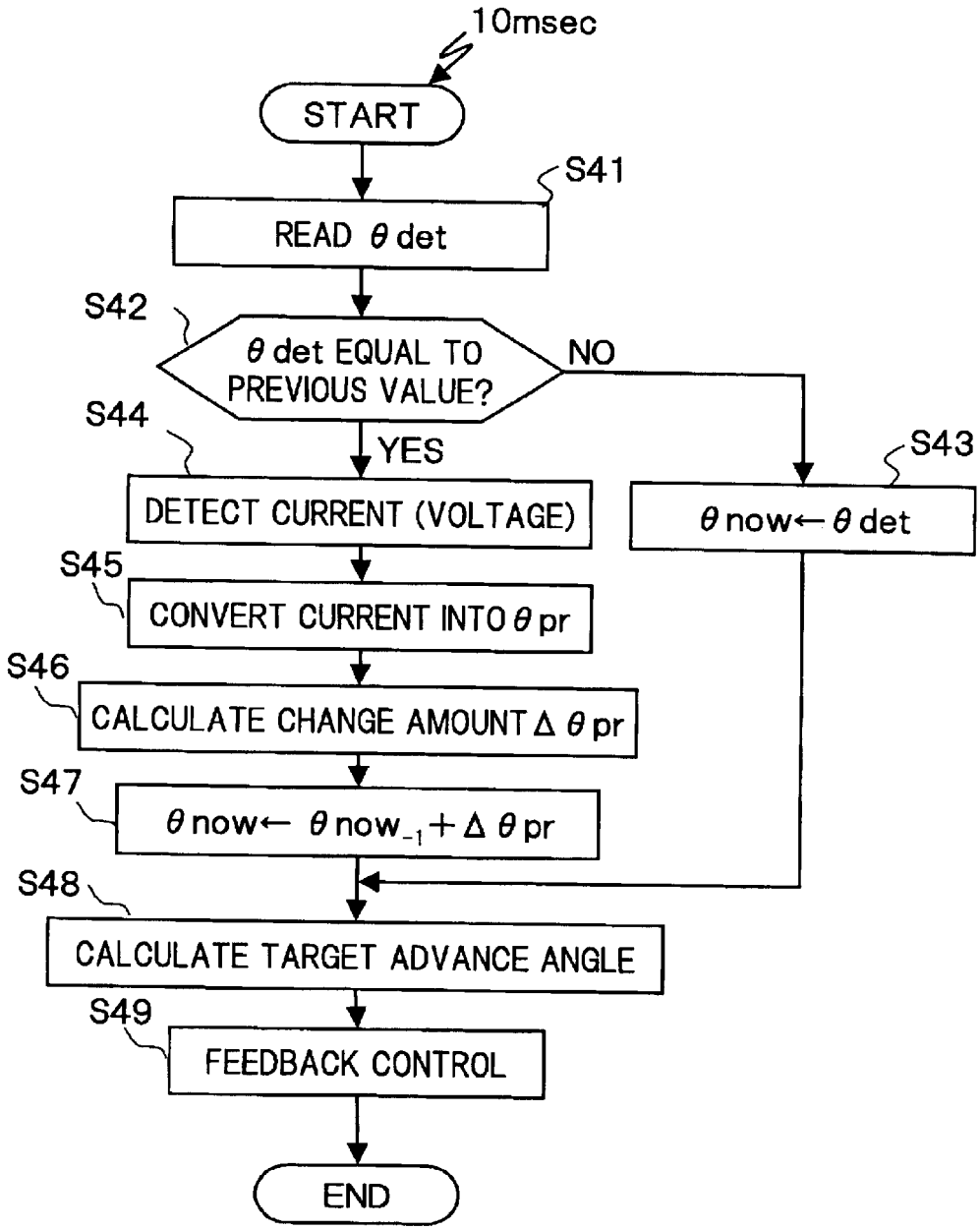
FIG. 9 is a flowchart showing a feedback control of rotation phase in the embodiment.

On the other hand, the flowchart of FIG. 9 shows the routine of feedback control of variable valve timing mechanism 113, and this routine is interruptedly executed at each predetermined short time of period (for example, 10 msec).

In step S41, the detection value θdet is read.

In step S42, it is judged whether or not a detection value $\theta det_{-1}$ read at the previous execution of this routine is equal to the detection value θdet read at present time.

To be in detail, in step S42, it is judged whether or not $|\theta det-\theta det_{-1}| \leqq \alpha a$.

When the previous value $\theta det_{-1}$ differs from the present value θdet, it is judged that it is the timing immediately after the detection value θdet is updated, and the control proceeds to step S43.

In step S43, the detection value θdet read at the present time is set to an actual angle θnow to be used for the feedback control.

Contrary to the above, when the previous value $\theta det_{-1}$ is equal to the present value θdet, it is judged that it is the second or subsequent timing after the detection value θdet is updated, and the control proceeds to step S44.

In step S44, the currents (or voltages) of electromagnetic brakes 26 and 27 are detected.

In the case where the current (voltage) is controlled by duty controlling the power supply to each of electromagnetic brakes 26 and 27, it is possible to set a duty control signal to a value equivalent to the current (voltage).

Further, the current or voltage may be measured by means of an ammeter or a voltmeter.

In the above current (voltage) detection, the current (voltage) of first electromagnetic brake 26 is indicated by plus sign and the current (voltage) of second electromagnetic brake 27 is indicated by minus sign, so that the current (voltage) in the advance direction and the current (voltage) in the retarded direction can be distinguished from each other.

Then, in step S45, a current value I is converted into a conversion value θpr based on a transfer function G(s) indicating a correlation of the current and the phase advance value.

In step S46, a difference Δθpr between a conversion value $\theta pr_{-1}$ obtained in step S45 at the previous execution and the conversion value θpr obtained in step S45 at the present execution, is calculated.

$$\Delta\theta pr=\theta pr-\theta pr_{-1}$$

In step S47, a result obtained by adding Δθpr to an actual angle $\theta now_{-1}$ set at the previous execution, is set as the actual angle θnow of the present time.

$$\theta now=\theta now_{-1}+\Delta\theta pr$$

Figure 11:
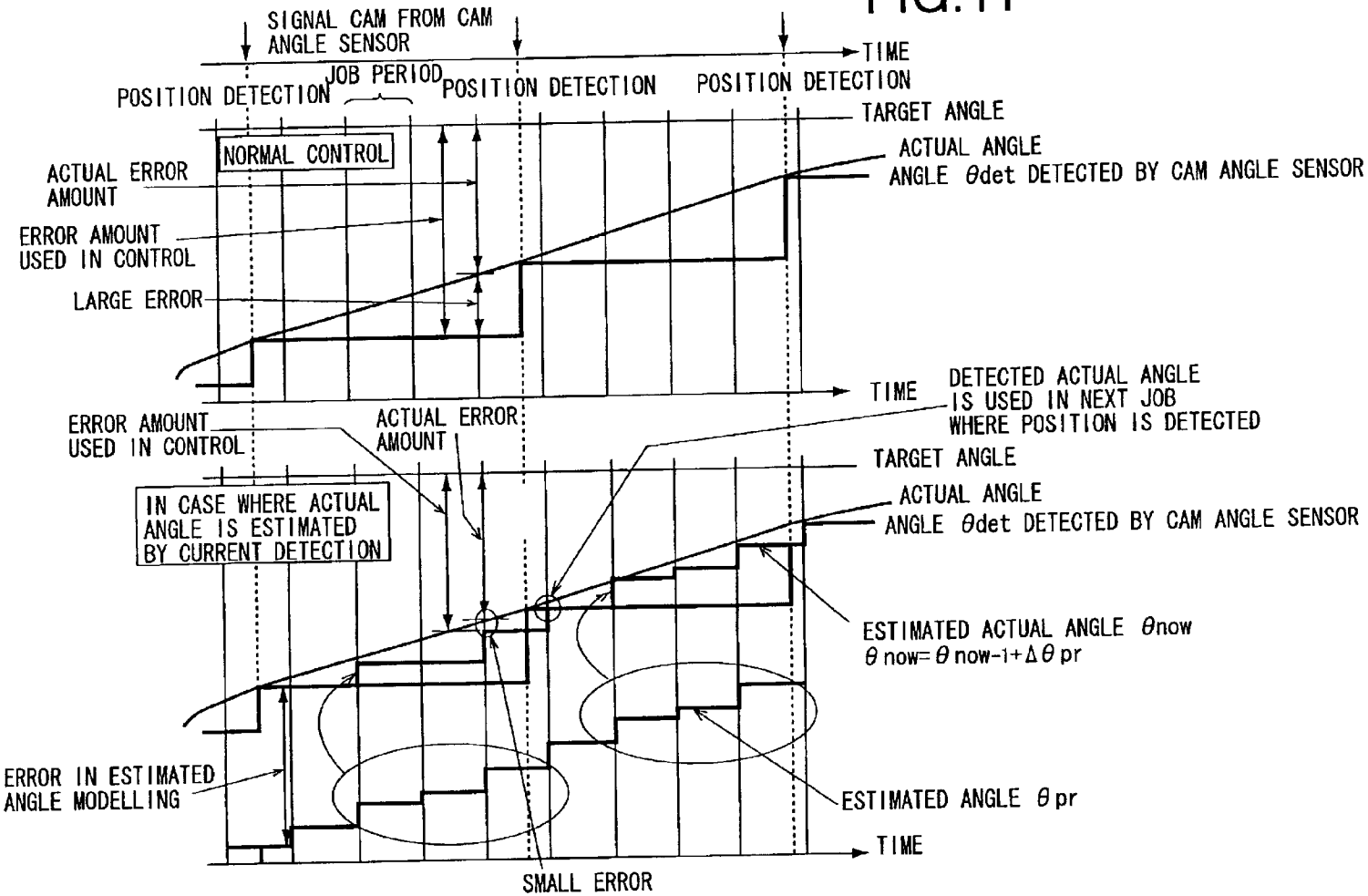
FIG. 11 is a time chart showing a correlation among the detection value θdet, a conversion value θpr and the actual angle θnow.

Accordingly, in the case where the present routine is executed two times or more at generation intervals of cam angle signal CAM in the low rotation state of the engine, in the second or subsequent execution of the routine, a subsequent change in the advance value is estimated based on the currents (voltages) of electromagnetic brakes 26 and 27, with the recent detection value θdet being a reference (see FIG. 11).

Then, in step S48, the target advance value (target rotation phase) is determined based on the engine operating conditions (engine load, engine rotation speed).

In step S49, the power supply to electromagnetic brakes 26 and 27 is feedback controlled based on a deviation between the actual angle θnow and the target advance value.

Figure 10:
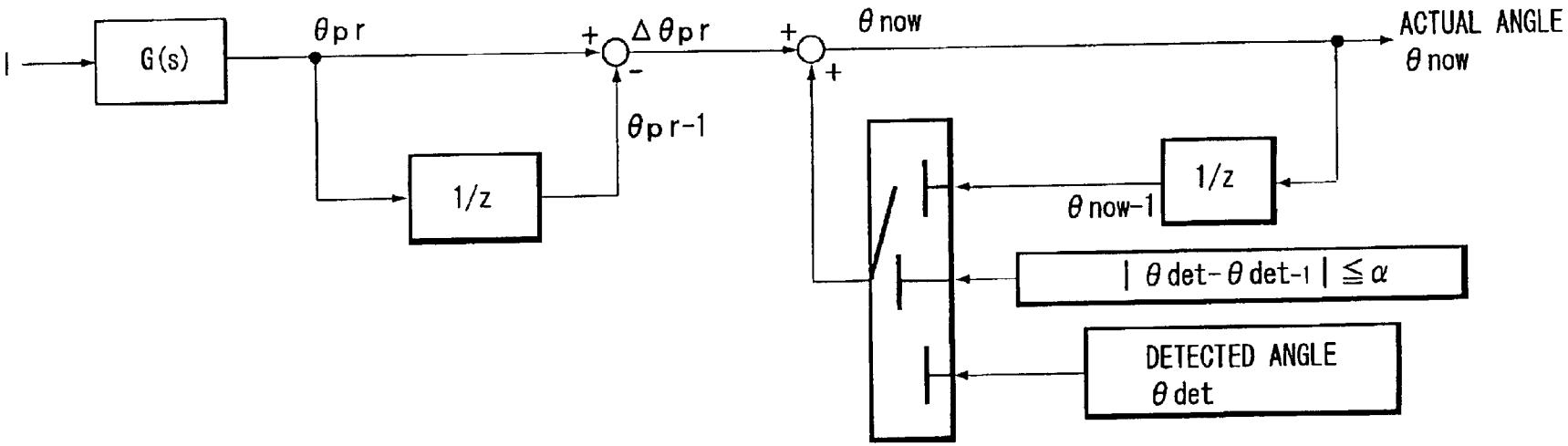
FIG. 10 is a block diagram showing a setting process of an actual angle θnow in the embodiment.

Note, in the steps shown in the flowchart of FIG. 9, steps S41 to S47, that is, the process of obtaining the actual angle θnow, can be shown in a block diagram of FIG. 10.

In the case where the detection value θdet is used as it is to feedback control the power supply to electromagnetic brakes 26 and 27, and also the engine is in the low rotation state, the power supply to electromagnetic brakes 26 and 27 is feedback controlled based on a value different from the actual advance value, during the detection value θdet is updated.

However, if the change in the rotation phase during the detection value θdet is updated is estimated to update the actual angle θnow as in the above constitution, it is possible to feedback control the power supply to electromagnetic brakes 26 and 27 based on an angle closer to the actual advance value, even in the engine low rotation state. Thus, the overshooting of rotation phase can be avoided.

Moreover, the conversion value θpr obtained by converting the currents (voltages) of electromagnetic brakes 26 and 27 based on the transfer function, is not set to the actual angle θnow for control just as it is, but a change portion of the conversion value θpr is sequentially integrated on the detection value θdet obtained based on the sensor signal. Therefore, even if there is an error in the conversion value θpr, it is possible to set accurately the actual angle θnow for use in the control.

The variable valve timing mechanism may be of another constitution in which a rotation phase of a camshaft relative to a crankshaft is varied by an actuator. Further, the actuator is not limited to the electromagnetic brake.

The entire contents of Japanese Patent Application No. 2002-318371 filed on Oct. 31, 2002, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed are:

1. A control apparatus of a variable valve timing mechanism that changes a rotation phase of a camshaft relative to a crankshaft of an internal combustion engine by an actuator, comprising:

a first sensor outputting a signal synchronized with the rotation of said crankshaft;

a second sensor outputting a signal synchronized with the rotation of said camshaft;

a phase detecting section that detects said rotation phase based on the signals from said first and second sensors;

a controlled variable detecting section that detects controlled variable of said actuator;

a conversion section that converts said controlled variable into the rotation phase with a transfer function representing said variable valve timing mechanism;

an estimation value calculating section that calculates an estimation value of rotation phase based on the rotation phase detected by said phase detecting section and the rotation phase obtained by said conversion section; and a control section that outputs an operating signal to said actuator based on said estimation value and a desired value.

2. A control apparatus of a variable valve timing mechanism according to claim 1, wherein said estimation value calculating section calculates a change amount per unit time of the rotation phase obtained by said conversion section, and calculates the estimation value of rotation phase based on the rotation phase detected by said phase detecting section and said change amount.

3. A control apparatus of a variable valve timing mechanism according to claim 2, wherein said estimation value calculating section adds to a most newest value of the rotation phase detected by said phase detecting section, an integral value of said change amount calculated after said most newest value is calculated, to calculate the estimation value of rotation phase.

4. A control apparatus of a variable valve timing mechanism according to claim 3, wherein said estimation value calculating section reads the detection result of the rotation phase in said phase detecting section at each fixed period of time, and judges whether or not the rotation phase is updated by said phase detecting section based on a change in the rotation phase during said fixed period of time.

5. A control apparatus of a variable valve timing mechanism according to claim 1, wherein said first sensor outputs a signal at each unit angle of said crankshaft and a signal at each reference angle of said crankshaft, and also said second sensor outputs a signal at each reference angle of said camshaft, and said phase detecting section counts up the signal at each unit angle of said crankshaft during a period of from the signal at each reference angle of said crankshaft to the signal at each reference angle of said camshaft, to detect the rotation phase based on the counted value.

6. A control apparatus of a variable valve timing mechanism according to claim 1, wherein said actuator is an electromagnetic actuator, and said controlled variable detecting section detects the current of said electromagnetic actuator.

7. A control apparatus of a variable valve timing mechanism according to claim 1, wherein said actuator is an electromagnetic actuator, and said controlled variable detecting section detects the voltage of said electromagnetic actuator.

8. A control apparatus of a variable valve timing mechanism according to claim 1, wherein said variable valve timing mechanism changes the rotation phase of the camshaft relative to the crankshaft of the internal combustion engine by a braking force of an electromagnetic brake as said actuator.

9. A control apparatus of a variable valve timing mechanism according to claim 1, wherein said variable valve timing mechanism is constituted so that;

a driving rotor that is transmitted with the rotation of the crankshaft of the internal combustion engine and a driven rotor on the camshaft side are coaxially connected with each other via an assembling angle adjusting mechanism, and an assembling angle between said driving rotor and said driven rotor is changed by said assembling angle adjusting mechanism, to vary valve timing, and wherein said assembling angle adjusting mechanism includes a link arm with a rotating portion on a first end portion thereof and a sliding portion on a second end portion thereof, a guide plate formed with a spiral guide groove, and an electromagnetic brake relatively rotating said guide plate with respect to said driving rotor, the rotating portion of said link arm is rotatably connected with one of said driving rotor and said driven rotor, and the sliding portion of said link arm is slidably connected with a radial guide formed on the other of said driving rotor and said driven rotor, the sliding portion of said link arm is fitted with the spiral guide groove of said guide plate, and said guide plate is relatively rotated with respect to said driving rotor by said electromagnetic brake so that the sliding portion of said link arm is slid in radial along said radial guide, to change the assembling angle between said driving rotor and said driven rotor.

10. A control apparatus of a variable valve timing mechanism that changes a rotation phase of a camshaft relative to a crankshaft of an internal combustion engine by an actuator, comprising:

crank angle signal outputting means for outputting a crank angle signal synchronized with the rotation of said crankshaft;

cam angle signal outputting means for outputting a cam angle signal synchronized with the rotation of said camshaft;

phase detecting means for detecting said rotation phase based on said crank angle signal and said cam angle signal;

controlled variable detecting means for detecting controlled variable of said actuator;

conversion means for converting said controlled variable into the rotation phase with a transfer function representing said variable valve timing mechanism;

estimation value calculating means for calculating an estimation value of rotation phase based on the rotation phase detected by said phase detecting means and the rotation phase obtained by said conversion means; and operating signal outputting means for outputting an operating signal to said actuator based on said estimation value and a desired value.

11. A control method of a variable valve timing mechanism that changes a rotation phase of a camshaft relative to a crankshaft of an internal combustion engine by an actuator, comprising the steps of:

outputting a crank angle signal synchronized with the rotation of said crankshaft;

outputting a cam angle signal synchronized with the rotation of said camshaft;

detecting said rotation phase based on said crank angle signal and said cam angle signal;

detecting controlled variable of said actuator;

converting said controlled variable into the rotation phase with a transfer function representing said variable valve timing mechanism;

calculating an estimation value of rotation phase based on the rotation phase detected based on said crank angle signal and said cam angle signal, and the rotation phase obtained by converting said controlled variable; and outputting an operating signal to said actuator based on said estimation value and a desired value.

12. A control method of a variable valve timing mechanism according to claim 11, wherein said step of calculating an estimation value comprises the steps of:

calculating a change amount per unit time of the rotation phase obtained by converting said controlled variable; and calculating the estimation value of rotation phase based on the rotation phase detected based on said crank angle signal and said cam angle signal, and said change amount.

13. A control method of a variable valve timing mechanism according to claim 11, wherein said step of calculating an estimation value comprises the steps of:

calculating a change amount per unit time of the rotation phase obtained by converting said controlled variable;

adding to a most newest value of the rotation phase detected based on said crank angle signal and said cam angle signal, an integral value of said change amount calculated after said most newest value is calculated; and setting the adding result to the estimation value of rotation phase.

14. A control method of a variable valve timing mechanism according to claim 13, wherein said step of calculating an estimation value further comprises the steps of:

reading the detection result of the rotation phase in said step of detecting a rotation phase at each fixed period of time; and judging whether or not the rotation phase is updated in said step of detecting a rotation phase based on a change in the rotation phase during said fixed period of time.

15. A control method of a variable valve timing mechanism according to claim 11, wherein said step of outputting a crank angle signal outputs a signal at each unit angle of said crankshaft and a signal at each reference angle of said crankshaft, and also said step of outputting a cam angle signal outputs a signal at each reference angle of said camshaft, and said step of detecting a rotation phase comprises the steps of:

counting up the signal at each unit angle of said crankshaft during a period of from the signal at each reference angle of said crankshaft to the signal at each reference angle of said camshaft; and detecting the rotation phase based on the counted value.

16. A control method of a variable valve timing mechanism according to claim 11, wherein said actuator is an electromagnetic actuator, and said step of detecting controlled variable detects the current of said electromagnetic actuator.

17. A control method of a variable valve timing mechanism according to claim 11, wherein said actuator is an electromagnetic actuator, and said step of detecting controlled variable detects the voltage of said electromagnetic actuator.

* * * * *